US005985819A

United States Patent [19]

Lu et al.

[11] Patent Number: 5,985,819

[45] **Date of Patent: *Nov. 16, 1999**

[54] BLOOMING PINE OIL CONTAINING COMPOSITIONS

[75] Inventors: Robert Zhong Lu, Hasbrouck Heights; Dennis Thomas Smialowicz, Waldwick, both of N.J.

[73] Assignee: Reckitt & Colman Inc., Wayne, N.J.

[ * ] Notice: This patent is subject to a terminal disclaimer.

[21] Appl. No.: 08/840,613

[22] Filed: Apr. 29, 1997

Related U.S. Application Data

[63] Continuation-in-part of application No. 08/584,835, Jan. 11, 1996, abandoned.

[30] Foreign Application Priority Data

Nov. 14, 1995 [GB] United Kingdom ..... 9523222

[51] Int. Cl.[6] ..... C11D 1/835; C11D 3/48

[52] U.S. Cl. ..... 510/463; 510/365; 510/384; 510/423

[58] Field of Search ..... 510/463

[56] References Cited

U.S. PATENT DOCUMENTS

| | | | |
|---|---|---|---|
| 3,666,668 | 5/1972 | Klausner | 252/90 |
| 4,597,887 | 7/1986 | Colodney et al. | 252/106 |
| 5,435,935 | 7/1995 | Kupneski | 252/156 |
| 5,591,708 | 1/1997 | Richter | 510/463 |
| 5,629,280 | 5/1997 | Richter et al. | 510/463 |
| 5,728,672 | 3/1998 | Richter | 510/463 |

FOREIGN PATENT DOCUMENTS

| | | | |
|---|---|---|---|
| 1120820 | 3/1982 | Canada | C11D 1/72 |

OTHER PUBLICATIONS

Copy of PCT Search Report for PCT Application No. PCT/US96/15588 dated Mar. 11, 1997.

*Primary Examiner*—Ellen M. McAvoy
*Attorney, Agent, or Firm*—Fish & Richardson P.C.

[57] ABSTRACT

Pine oil type concentrate compositions and cleaning compositions providing sanitizing effects comprise a germicidal active cationic surfactant, a co-solvent, a non-ionic surfactant system, and generally include a relatively high amount of fragrance and/or fragrance adjuvant compositions. The preferred embodiments of the pine oil type cleaning compositions provide the benefits of good cleaning, effective sanitizing action, good blooming upon addition to an excess of water and long lasting fragrance, and low irritancy levels notwithstanding the relatively high levels of organic solvents comprised in the compositions.

16 Claims, 1 Drawing Sheet

BLOOMING PINE OIL CONTAINING COMPOSITIONS

Figure 1:
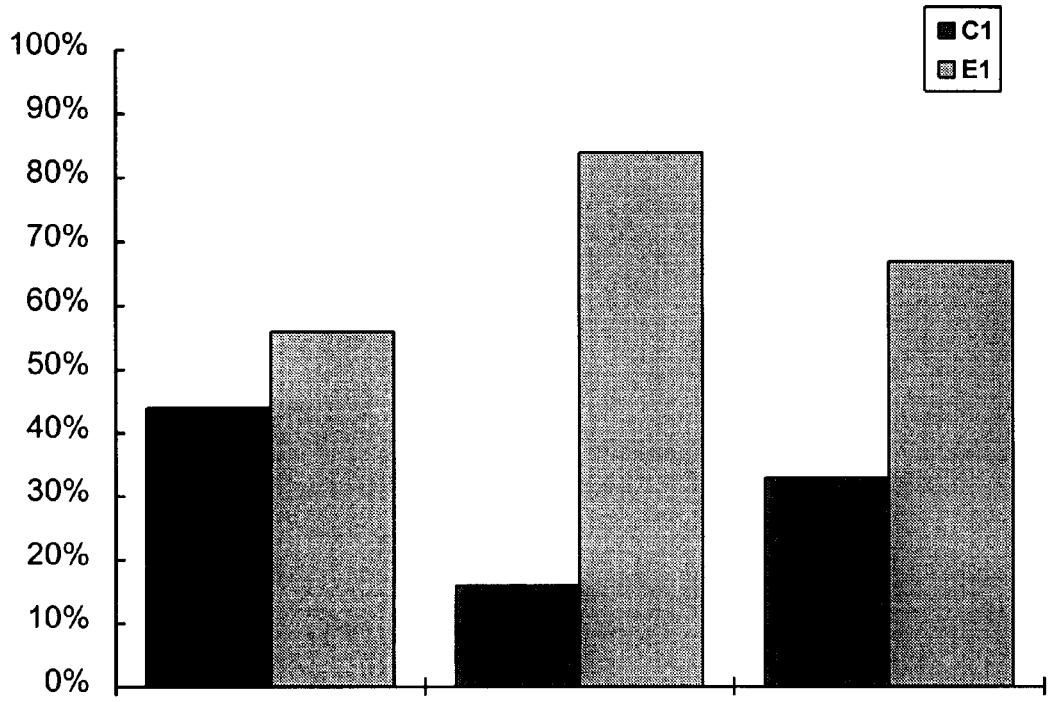

This is a continuation-in-part application of U.S. Ser. No. 08/584,835, filed Jan. 11, 1996, now abandoned.

The present invention relates to improvements in cleaning compositions. More particularly, the present invention is directed to improved pine oil type cleaning compositions and concentrates thereof, which find particular use in hard surface cleaning applications.

Cleaning compositions are commercially important products and enjoy a wide field of utility in assisting in the removal of dirt and grime from surfaces, especially those characterized as useful with "hard surfaces". One particular category of cleaning compositions are those which are classed as pine oil type cleaning compositions which typically include one or more of the following identifying characteristics: containing an amount of one or more resins or oils derived from coniferous species of trees; containing natural fragrances or synthetic fragrance compositions which are intended to mimic the scent of of one or more resins or oils derived from coniferous species of trees; a color ranging from colorless to a deep amber, deep amber yellow or deep amber reddish color; generation of a milky or cloudy appearance when diluted with water in dilutions useful for cleaning applications. Such pine oil type cleaning compositions are generally provided in a concentrated composition which is subsequently diluted with water by an end user/consumer to form a cleaning composition therefrom.

While such pine oil type cleaning compositions are commercially significant and in popular use, their use is not without attendant shortcomings. For example, high levels of pine oil in a cleaning composition are known to be good cleaning agent, and to provide a pleasant scent to a cleaning composition, pine oils also are known to leave undesirable surface residues, particularly on hard surfaces. Further, pine oils are also known irritants particularly to the eyes, skin and mucocus tissues. One or more of these undesirable effects may be minimized by reducing the amount of pine oil in a composition, but such a reduction reduces the cleaning efficacy of a cleaning composition, as well as the scent, both frequently highly desirable characteristics. Further, pine oil, while known to have cleaning efficacy is not generally considered useful as a broad spectrum antibacterial or sanitizing agent, which is also frequently desired property in such pine oil type cleaning compositions. Thus, in view of the foregoing it is apparent that there is a continuing need in the art for improved pine oil type cleaning compositions which exhibit one or more of the identifying characteristics outlined above which are important indicia for consumer acceptance, while at the same time further providing an effective sanitizing effect and a long lasting scent.

Various formulations directed to the production of pine oil type cleaners with reduced pine oil content have been proposed. For example, CA 1153267 teaches a pine oil type cleaning composition which includes 0 to 8% by weight pine oil, but which also requires that a minimum of 5.6% by weight alpha terpineol be present. Further, CA 1120820 describes disinfecting pine oil type cleaning composition which includes among other essential constituents, from 5 to 30 percent by weight of pine oil. Currently copending and commonly assigned U.S. application Ser. No. 08/523,413 now U.S. Pat. No. 5,591,708, teaches pine oil type cleaning compositions which include reduced amounts of pine oil, but which only teach the use of certain germicidal cationic surfactant compositions as optional constituents. Also, copending and commonly assigned U.S. application Ser. No. 08/523,412 now U.S. Pat. No. 5,629,280, teaches pine oil type cleaning compositions which feature germicidal activity but which do not teach the inclusion of large percentages of a fragrance and/or fragrance solubilizer constituent; such constituents are generally organic compounds and would be expected to have a significant potential to detract or eliminate the blooming behavior taught in that specification. Further, none of the examples in U.S. Ser. No. 08/523,413 or U.S. Ser. No. 08/523,412 illustrate among their respective example formulations the addition of any further amount of fragrance and/or fragrance solubilizer constituents. While these above recited compositions may be advantageous in certain respects, these compositions as well as other art known compositions and formulations are not without attendant shortcomings, which shortcomings the present applicant addresses.

It is therefore among the objects of the invention to provide a cleaning compositions and concentrates thereof which exhibit one or more of the identifying characteristics of pine oil type cleaning compositions described above, particularly those which exhibit excellent cleaning efficacy, satisfactory "blooming" behaviour and a satisfactory germicidal effect. In preferred concentrates, there is further provided a high concentration of fragrance and/or fragrance solubilizer constituents which impart a long lasting scent to surfaces and wherein the cleaning compositions have been used.

It is further object of the invention to provide commercially acceptable shelf stable concentrated cleaning compositions which exhibit one or more of the identifying characteristics of pine oil type cleaning compositions described above, particularly those which exhibit high concentrations of fragrance and/or fragrance solubilizer constituents, which concentrated cleaning compositions are readily dilutable with water to form useful cleaning compositions.

A still further object of the invention is the provision of cleaning compositions and concentrates which exhibit one or more of the identifying characteristics of pine oil type cleaning compositions described above, which composition further include one or more constituents which impart a disinfectant properties to the cleaning compositions formed from such concentrates.

A yet further object of the invention is the provision of pourable concentrated cleaning compositions exhibit one or more of the identifying characteristics of pine oil type cleaning compositions described above which are readily dilutable in water.

These and other objects of the invention will become apparent from the following detailed description of the invention.

The compositions according to the invention comprise the following constituents:

Constituent A) a pine oil preparation containing at least about 60% terpene alcohols;

Constituent B) a co-solvent;

Constituent C) a non-ionic surfactant system which desirably includes two or more non-ionic surfactants wherein at least one of which exhibits a cloud point of 20° C. or less in water;

Constituent D) at least one cationic quaternary ammonium surfactant which exhibits germicidal activity;

Constituent E): fragrance/fragrance enhancer;

Constituent F): water.

In addition to the above described constituents, the compositions according to the invention may optionally further include known art additives in conventional amounts.

The inventors have found that it is now possible to produce certain concentrate compositions utilizing these selected constituents in particular formulations which provide pine oil type cleaning compositions in a concentrated liquid form which unlike many known prior art composition further include a germicidal effect, good blooming and a high concentration of fragrance and/or fragrance solubilizer constituents. Surprisingly however, these inventive compositions still exhibit many of the desirable characteristics of pine oil type cleaning compositions described above, especially "blooming", notwithstanding the relatively high levels of fragrance and/or fragrance solubilizer constituents which they comprise. This is an important and surprising feature of the invention as the use of relatively higher amounts of fragrance and/or fragrance solubilizer constituents, which are known to be organic constituents, would be expected to significantly diminish or deactivate the desirable "blooming" effect when such concentrates are further diluted with water. The "blooming" observed may be described as the change of the water's appearance from essentially colorless and transparent to that of a milky white or milky yellowish white, cloudy appearance. This effect is also sometimes referred to as the "break". Such blooming is a highly desirable in such pine oil type cleaning compositions as consumer/end user expectations associate cleaning effectiveness with the extent and degree of this blooming upon formation of a cleaning composition. That such behaviour is achieved in the compositions according to the present invention, which contain relatively high amounts of fragrance and/or fragrance solubilizer constituents, is surprising to say the least.

Constituent A) Compositions according to the invention comprise a pine oil constitutent. Pine oil is an organic solvent, and is a complex blend of oils, alcohols, acids, esters, aldehydes and other organic compounds. These include terpenes which include a large number of related alcohols or ketones. Some important constituents include terpineol, which is one of three isomeric alcohols having the basic molecular formula $C_{10}H_{17}OH$. One type of pine oil, synthetic pine oil, will generally have a specific gravity, at 15.5° C. of about 0.9300, which is lower than the two other grades of pine oil, namely steam distilled and sulfate pine oils, and will generally contain a higher content of turpentine alcohols. Other important compounds include alpha- and beta-pinene (turpentine), abietic acid (rosin), and other isoprene derivatives.

Particularly effective pine oils which are presently commercially available include Unipine® 60 (from Union Camp, which is believed to contain approximately 60% terpene alcohols), Unipine® S-70 and Unipine® S-70 (from Union Camp, both are believed to contain approximately 70% terpene alcohols), Unipine® S and Unipine® 80 (from Union Camp, both are believed to contain approximately 80% terpene alcohols), Unipine® 80 (from Union Camp, which is believed to contain approximately 80% terpene alcohols), Unipine® 85 (from Union Camp, which is believed to contain approximately 85% terpene alcohols), Unipine® 90 (from Union Camp, which is believed to contain approximately 90% terpene alcohols), as well as Alpha Terpineol 90 (from Union Camp, which is believed to contain approximately 100% terpene alcohols). Futher effective pine oils include Glidco® Pine Oil™ 60 (available from Glidco Organics Corp., Jacksonville, Fla., believed to contain approximately 60% terpene alcohols), Glidco® Pine Oil 60 (available from Glidco Organics Corp., Jacksonville, Fla., believed to contain approximately 60% terpene alcohols); Glidco® Pine Oil 140 (available from Glidco Organics Corp., Jacksonville, Fla., believed to contain approximately 70% terpene alcohols); Glidco® Pine Oil 80 (available from Glidco Organics Corp., Jacksonville, Fla., believed to contain approximately 80% terpene alcohols) Glidco® Pine Oil 150 (available from Glidco Organics Corp., Jacksonville, Fla., believed to contain approximately 85% terpene alcohols); Glidco® Terpene SW (available from Glidco Organics Corp., Jacksonville, Fla., believed to contain approximately 75% terpene alcohols); as well as Glidco® Terpineol 350 (available from Glidco Organics Corp., Jacksonville, Fla., believed to contain approximately 100% terpene alcohols). Other products which can contain up to 100% pure alpha-terpineol, may also be used in the present invention.

The pine oil constituent may be present in the concentrate compositions in amounts of from about 0.001% by weight to up to about 15% by weight, preferably in amounts of up to about 4–12% by weight, but most preferably in amount of between 6–10% pine oil by weight. As with all of the weight percentages of the constituents described, the weight percentages are indicative of the weight percentages of the actives in a constituent containing preparation.

Preferred as the pine oil constituent of the present invention are pine oil preparations which comprise at least about 60% terpene alcohols, and more preferably those which comprise at least about 80% terpene alcohols.

Constituent B) A further constituent according to the invention is a co-solvent which is present in addition to the pine oil which is itself known to be an organic solvent. This co-solvent assists in improving the dispersability and/or miscibility of the water insoluble pine oil in water. The solubilizing agent also desirably contributes to the dispersability and/or miscibility of further constituents according to the present invention, including any water insoluble or poorly soluble constituents including certain alcohol ethoxylates, alkanolamides and fragrances each of which are described in more detail below. Many useful co-solvents which are known to be useful in dispersing pine oil in water may be used as Constituent B, and many of these co-solvents are based on organic solvents; particularly useful are organic solvents which are also known to provide good detersive action and/or good solubilization of greases and fats which may be found in many surface soils. Any co-solvent which is demonstrated to be exhibit effective pine oil solubilization and which do not undesirably detract from the other features of the present invention, particularly the blooming characteristics of the invention, as well as the sanitization characteristics of the invention, may be used. Mixtures of two or more co-solvents may also be used as Constituent B.

Exemplary co-solvents useful as Constituent B include certain glycols and glycol ethers which exhibit the above described properties. Examples of such glycol ethers include those having the general structure $R_9$—O—$R_{10}$—OH, wherein $R_9$ is an alkoxy of 1 to 20 carbon atoms, or aryloxy of at least 6 carbon atoms, and $R_{10}$ is an ether condensate of propylene glycol and/or ethylene glycol having from one to ten glycol monomer units. Examples of such useful glycol ethers include propylene glycol methyl ether, dipropylene glycol methyl ether, tripropylene glycol methyl ether, propylene glycol isobutyl ether, ethylene glycol methyl ether, ethylene glycol ethyl ether, ethylene glycol butyl ether, diethylene glycol phenyl ether, propylene glycol phenol ether, and mixtures thereof. Such glycol ethers are presently commercially available from a number of sources. More preferably employed as the co-solvent of Constituent B is one or more glycol ethers of the group consisting of ethylene glycol n-butyl ether, diethylene glycol n-butyl ether, and mixtures thereof A particularly useful co-solvent which exhibits good detersive effects as well as good solubilization of pine oil in water is diethylene glycol n-butyl ether [also recognized by the names 2-(2-butoxyethoxy)ethanol, butoxydiglycol and diethylene glycol monobutyl ether] having the formula: $C_4H_9OCH_2CH_2OCH_2CH_2OH$, as available for example in the DOWANOL™ glycol ether series (most preferably as DOWANOL DB diethylene glycol n-butyl ether) available from The Dow Chemical Company, Midland Michigan, or as Butyl CARBITOL™ from Union Carbide.

Further exemplary co-solvents useful as Constituent B include $C_1$–$C_8$ alcohols, especially $C_1$–$C_3$ alcohols, of which isopropanol is preferred. Such alcohols provide effective solubilization of many types of greases and fats which may be encountered in soils, as well as being useful in the solubilization of pine oil in water, without substantially interfering with the blooming and scent characteristics of the compositions according to the present invention.

While the exact amount of the solubilizing agent required to effectively solubilize the pine oil constituent, as well as any further aqueous insoluble or poorly aqueous miscible constituents, may vary from composition to composition, it has generally been found the addition of only a minimum effective amount which is found to be effective in dispersing or solubilizing the pine oil constituent and any other aqueous insoluble or poorly soluble constituents in the concentrate compositions is desirably used. Such is due to desire to reduce the amount of volatile organic constituents in the concentrate compositions of the invention, which volatile organic constituents are desirably minimized from an environmental standpoint. The present inventors have found that inclusion of the solubilizing agent according to Constituent B in amounts of about 0.001% by weight to about 15% by weight have been found to be effective to solubilize the pine oil, as well as in solubilizing other less water soluble constituents present in the concentrate compositions of the invention. Preferably, the solubilizing agent of Constituent B is present in amounts 4–12% by weight, and most preferably 8–10% by weight are used in the concentrate compositions of the invention.

Constituent C) A further constituent of the concentrate compositions according to the invention is a nonionic surfactant system which comprises a mixture of two or more nonionic surfactants which includes a first nonionic surfactant constituent which is a single or is a mixture of noninonic surfactants which exhibit a cloud point of 20° C. or less in water, and a second nonionic surfactant constituent which includes a single nonionic surfactant or mixture of surfactants which are useful in solubilizing the first nonionic surfactant constituent in water. The first said nonionic surfactant constituent is generally selected to be one or more aqueous insoluble or poorly soluble surfactants are nonionic surfactants which either singly, or in combination, which optionally, but further very desirably exhibit a cloud point of 20° C. or less in water. The second nonionic surfactant constituent is generally selected to provide good cleaning efficacy particularly of stains and soils, as well as having a solubilizing effect of the first nonionic surfactant in the concentrated compositions according to the present invention; such a solubilizing effect is important as it aids in the long term shelf stability of prepared concentrated compositions, as well as in ensuring the optical clarity of concentrated compositions particularly during the shelf life of prepared concentrated compositions.

Generally, suitable nonionic surface active agents which may be used in the nonionic surfactant system according to Constituent C includes condensation products of one or more alkylene oxide groups with an organic hydrophobic compound, such as an aliphatic or alkyl aromatic compound. Exemplary suitable nonionic surface active agents include surfactant compositions based upon polyethoxylated, polypropoxylated, or polyglycerolated alcohols, alkylphenols or fatty acids.

One exemplary class of nonionic surfactants useful in Constituent C according to the instant invention include certain alkoxylated linear aliphatic alcohol surfactants which are believed to be the condensation products of a $C_1$–$C_{10}$ hydrophilic moiety with polyethylene oxide/polypropylene oxide moieties. Such alkoxylated linear alcohol surfactants are presently commercially available under the tradename Poly-Tergent® (Olin Chemical Co., Stamford Conn.) and of these particularly useful are those which are marketed as Poly-Tergent® SL-22, Poly-Tergent® SL-42, Poly-Tergent® SL-62 and Poly-Tergent® SL-29, of which Poly-Tergent® SL-62 is particularly advantageous. Poly-Tergent® SL-42 is described as being a moderately foaming, biodegradable alkoxylated linear alcohol surfactant having on average 5 moles of oxyethylene groups per molecule. Poly-Tergent® SL-62 is described as being a moderately foaming, biodegradable alkoxylated linear alcohol surfactant having on average 8 moles of oxyethylene groups per molecule. These alkoxylated linear alcohol surfactants provide good detersive action in the removal of many types of fats and greases such as are frequently found in soils on hard surfaces, as well as providing a further solubilizing effects and may be included in the concentrate compositions according to the present invention with advantage.

A further exemplary class of nonionic surfactants which finds use are alkoxylated alcohols especially alkoxylated fatty alcohols. These include ethoxylated and propoxylated fatty alcohols, as well as ethoxylated and propoxylated alkyl phenols, having both with alkyl chains of about 7–16, more preferably about 8–13 carbon chains in length.

Exemplary alkoxylated alcohols include certain ethoxylated alcohol compositions presently commercially available from the Shell Chemical Company, (Houston, Tex.) under the general trade name Neodol®, which are described to be linear alcohol ethoxylates. Of these, those exhibiting a cloud point of 20° C. or less may be used. Specific compositions include: Neodol® 91-2.5 which is described as an ethoxylated alcohol having an average molar ratio of 2.7:1 ethoxy groups/alcohol groups per molecule; a molecular weight of 281, and a cloud point in water of 20° C. and less; Neodol® 23-3 which is described as an ethoxylated alcohol having an average molar ratio of 2.9:1 1 ethoxy groups/alcohol groups per molecule; a molecular weight of 322, and a cloud point in water of 20° C. and less.

Exemplary alkoxylated alcohols further include certain compositions presently commercially available from the Union Carbide Co., (Danbury, Conn.) under the general trade name Tergitol®, which are described to be secondary alcohol ethoxylates. Again, those exhibiting a cloud point of 20° C. and less may be used. Specific compositions include: Tergitol® 15-S-3 which is described as an ethoxylated secondary alcohol having an average molar ratio of 3.2:1 ethoxy groups/alcohol groups per molecule, and a cloud point in water of less than 20° C.; Tergitol® 15-S-5 which is described to be an ethoxylated secondary alcohol having an average molar ratio of 5:1 ethoxy groups/alcohol groups per molecule, and a cloud point in water of less than 20° C.

Further exemplary nonionic surfactants which may be used in Constituent C include certain alkanolamides including but not limited to monoalkanolamides, dialkanolamides and trialkanolamides particularly fatty monoalkanolamides and fatty dialkanolamides. Commercially available monoethanol amides and diethanol amides include those marketed under the trade names Alakamide® and Cyclomide® by Rhône-Poulenc Co., (Cranbury, N.J.) and include Cyclomide® CDD-518 described to be a nonionic surfactant based on coconut diethanolamide; Cyclomide® C212 described to be a nonionic surfactant based on coconut monoethanolamide; Cyclomide® DC212 described to be a nonionic surfactant based on 2:1 coconut monoethanolamide; Cyclomide® DC212/M described to be a nonionic surfactant based on 2:1 modified coconut monoethanolamide; Cyclomide® DC212/S described to be a nonionic surfactant based on 1:1 coconut monoethanolamide; Cyclomide® DC212/SE described to be a nonionic surfactant based on 1:1 fatty acid diethanolamide; Cyclomide® DIN 100 described to be a nonionic surfactant based on lauric/linoleic diethanolamide; Cyclomide® DIN-295/S described to be a nonionic surfactant based on 1:1 linoleic diethanolamide; Cyclomide® DL203 described to be a nonionic surfactant based on 2:1 lauric diethanolamide; Cyclomide® DL203/S described to be a nonionic surfactant based on 1:1 lauric diethanolamide; Cyclomide® DL207/S and Cyclomide® DL207/SL described to be nonionic surfactants based on 1:1 lauric/myristic diethanolamide; Cyclomide® DO280 described to be a nonionic surfactant based on 2:1 oleic diethanolamide; Cyclomide® DO280/S described to be a nonionic surfactant based on 1:1 oleic diethanolamide; Cyclomide® DS 280/S described to be a nonionic surfactant based on 1:1 stearic diethanolamide; Cyclomide® KD described to be a nonionic surfactant based on 1:1 coconut diethanolamide; Cyclomide® LE described to be a nonionic surfactant based on 1:1 lauric diethanolamide; Cyclomide® LIPA described to be a nonionic surfactant based on lauric monoisopropanolamide; Cyclomide® L203 described to be a nonionic surfactant based on lauric monoethanolamide; Cyclomide® S280 described to be a nonionic surfactant based on stearic monoethanolamide; Cyclomide® WRS 1-66 described to be a nonionic surfactant based on diethanolamides of unsaturated fatty acids; Cyclomide® 101 CG described to be an alkanolamide nonionic surfactant; Cyclomide® 200 CGN based on coconut oil diethanolamide; as well as Cyclomide® 206 CGN and Cyclomide® 210 CGN, both described to be a nonionic surfactants based on coconut alkanolamide. Particularly preferred for use as the second nonionic surfactant constituent in Constituent C according to the invention includes lineolic diethanolamides and lauric diethanolamides.

Exemplary alkoxylated alkyl phenols useful in Constituent C include certain compositions presently commercially available from the Rhone-Poulenc Co., (Cranbury, N.J.) under the general trade name Igepal®, which are described to be octyl and nonyl phenols. Again, those exhibiting a cloud point of 20° C. or less may be used. Specific compositions include: Igepal® CA-210 which is described as an ethoxylated octyl phenol having an average of 1.5 ethoxy groups groups per molecule and a cloud point in water of less than 20° C. and, Igepal® CA-420 which is described as an ethoxylated octyl phenol having an average of 3 ethoxy groups groups per molecule and a cloud point in water of less than 20° C.

Especially preferred for use as the first nonionic surfactant constituent which comprises Constituent C according to the instant invention is Neodol® 91-2.5 which is described as an ethoxylated alcohol having an average molar ratio of 2.7:1 ethoxy groups/alcohol groups per molecule; a molecular weight of 281, and a cloud point in water of 20° C. and less.

Of course, a mixture of two or more nonionic surfactants having a cloud point of 20° C. or less may be incorporated into the inventive compositions. Other known nonionic surface active agents not particularly enumerated here may also be used. Such exemplary nonionic surface active agents are described in *McCutcheon's Detergents and Emulsifiers,* North American Edition, 1982; *Kirk-Othmer, Encyclopedia of Chemical Technology,* 3rd Ed., Vol. 22, pp. 346–387, the contents of which are herein incorporated by reference.

The cloud point of the first nonionic surfactant constituent according to Constituent C of the present invention may be determined by known methods. For example, ASTM D2024 (reapproved 1986) for "Standard Test method for Cloud Point of Nonionic Surfactants". According to this test method which is particularly useful for nonionic surfactants of a detergent systems which are characterized of less soluble in water at higher temperatures than at lower temperatures wherein the cloud point occurs within water at a temperature range of between 30–95° C. According the test protocol, a one percent test solution is prepared by weighing one gram of the surfactant into a 150 ml. beaker to which 100 mls. of distilled demineralized water at a temperature of less than 30° C. is added. The sample is agitated until solution is reached, after which a 50 ml. aliquot of the solution is placed into a test tube. While agitating the sample solutions slowly with the thermometer, the test tube is heated with a Bunsen burner until the sample solution becomes definitely cloudy, at which point it is removed from the heat. While stirring with the thermometer continues, the test tube and its sample solution are allowed to cool slowly until the sample solution clarifies at which point the temperature is noted. Such a test method provides a simple, yet reliable, means for determining the cloud point of a surfactant in water.

An even simpler test method for effectively determining which nonionic surfactants may be used as the first nonionic surfactant constituent in the compositions of the invention is as follows: to a clean beaker or other glass vessel is added 99 parts by weight of deionized water at 20° C.±0.5° C., and 1 part by weight (by weight of the actives) of a surfactant composition to be tested. This test sample is stirred and the temperature permitted to drop to 20° C.; if this test sample is observed to be murky or cloudy in appearance as the test sample's temperature achieves 20° C. and drops below 20° C., it is considered to have a suitable cloud point of 20° C. and less and may be used as Constituent B in the concentrate compositions according to the invention.

Constituent C, may be present in any effective amount, but desirably is present in the concentrate compositions in amounts of from as little as 0.001% by weight to amount of up to about 25% by weight, preferably in amounts of 0.1 and 20% by weight, but most preferably in amount of between 8 and 15% by weight.

Very desirably, Constituent C includes an alkanolamide which alkanolamide is present in an amount at least equal to the fragrance/fragrance enhancer constituent as it has been observed that such permits for the inclusion of higher amounts of fragrance in the compositions taught herein, while at the same time ensuring good blooming characteristics when added to a greater volume of water.

Further, very desirably Constituent C also includes an alkoxylated linear aliphatic alcohol surfactant constituent. It has been observed by the inventor that the inclusion of such aids in the solubilizing of the further non-aqueous constituents in water which is useful in the production of substantially clear or transparent concentrate compositions, and which provides a further beneficial cleaning effect. The presence of such alkoxylated linear aliphatic alcohol surfactants in Constituent C also aids in providing the long term shelf stability of the compositions, particularly the concentrate compositions. Such an alkoxylated linear aliphatic alcohol surfactant constituent may be added as part of Constituent C in any amount which is found to aid in improving the visual characteristics and/or the stability characteristics of the invention and may be added in amounts of as little as 0.001% weight based on the total weight of the compositions but greater amounts are usually found to be more effective.

While the compositions taught herein may be produced wherein Constituent C is limited to two nonionic surfactants of which one exhibits a cloud point of 20° C. or less in water; according to the most preferred embodiments, Constituent C includes at least three nonionic surfactants of which one exhibits which exhibits a cloud point of 20° C. or less in water, a second of which is an alkanolamide surfactant preferably in an amount equal to or greater than the amount of the fragrance/fragrance enhancer constituent, and a third of which is an alkoxylated linear aliphatic alcohol surfactant constituent in an amount effective in improving the visual characteristics and/or long term shelf stability of the compositions. Further nonionic surfactants may be further added to Constituent C if desired, such as to improve the cleaning benefit of the cleaning compositions.

Exemplary formulations of preferred compositions according to the instant invention, which include both the alkanolamide and the alkoxylated linear aliphatic alcohol surfactant as part of Constituent C are described in one or more of the examples discussed below.

Constituent D) The concentrate compositions according to the invention include as a necessary constituent at least one cationic surfactant which is found to provide a broad antibacterial or sanitizing function when combined with an effective amount of Constituent A, viz., the pine oil constituent, which may thereafter be solubilized by the addition of an effective amount of Constituent B, as described in more detail below. Any cationic surfactant which satisfies these requirements may be used and are considered to be within the scope of the present invention, and mixtures of two or more cationic surface active agents, viz., cationic surfactants may also be used. Cationic surfactants are well known, and useful cationic surfactants may be one or more of those described for example in *McCutcheon's Detergents and Emulsifiers,* North American Edition, 1982; *Kirk-Othmer, Encyclopedia of Chemical Technology,* 3rd Ed., Vol. 22, pp. 346–387, the contents of which are herein incorporated by reference.

Examples of preferred cationic surfactant compositions useful in the practice of the instant invention are those which provide a germicidal effect to the concentrate compositions, and especially preferred are quaternary ammonium compounds and salts thereof, which may be characterized by the general structural formula:

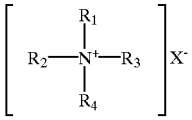

where at least one or $R_1$, $R_2$, $R_3$ and $R_4$ is a hydrophobic, aliphatic, aryl aliphatic or aliphatic aryl radical of from 6 to 26 carbon atoms, and the entire cation portion of the molecule has a molecular weight of at least 165. The hydrophobic radicals may be long-chain alkyl, long-chain alkoxy aryl, long-chain alkyl aryl, halogen-substituted long-chain alkyl aryl, long-chain alkyl phenoxy alkyl, aryl alkyl, etc. The remaining radicals on the nitrogen atoms other than the hydrophobic radicals are substituents of a hydrocarbon structure usually containing a total of no more than 12 carbon atoms. The radicals $R_1$, $R_2$, $R_3$ and $R_4$ may be straight chained or may be branched, but are preferably straight chained, and may include one or more amide or ether linkages. The radical X may be any salt-forming anionic radical.

Exemplary quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either amide or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Preferred quaternary ammonium compounds which act as germicides and which are be found useful in the practice of the present invention include those which have the structural formula:

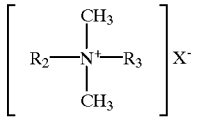

wherein $R_2$ and $R_3$ are the same or different $C_1$–$C_{12}$alkyl, or $R_2$ is $C_{12-16}$alkyl, $C_{8-18}$alkylethoxy, $C_{8-18}$alkylphenolethoxy and $R_3$ is benzyl, and X is a halide, for example chloride, bromide or iodide, or methosulfate. The alkyl groups recited in $R_2$ and $R_3$ may be straight chained or branched, but are preferably substantially linear.

Such quaternary germicides are usually sold as mixtures of two or more different quatenaries, such as BARDAC® 205M, (presently commercially available from Lonza, Inc., Fairlawn, N.J.) which is believed to be a 50% aqueous solution containing 20% by weight of an alkyl dimethyl benzylammonium chloride (50% C14, 40% C16 alkyl); 15% by weight of an octyl decyl dimethylammonium chloride; 7.5% by weight of dioctyl dimethylammonium chloride; and 7.5% by weight of didecyl dimethylammonium chloride. A further useful quaternary germicide is CYNCAL® 80% (presently commercially available from Hilton Davis Chemical Co., Cincinnati, Ohio) which is believed to comprise 80% by weight of an alkyl dimethyl benzylammonium chloride (50% C14, 40% C12 and 10% C16 alkyl), 10% water and 10% ethanol. Further useful quaternary germicidal agents include BTC-8358®, an alkyl benzyl dimethyl ammonium chloride (80% active) and BTC-818®, a dialkyl dimethyl ammonium chloride (both presently commercially available from the Stepan Chemical Co., Chicago, Ill.). Additional suitable commercially available quaternary ammonium germicides of the alkyl dimethyl benzylammonium chloride type containing the same alkyl dimethyl benzylammonium chloride mixture as that of CYNCAL® and which are generally referred to as quarternium salts include BARQUAT® MB-80, (presently commercially available from Lonza, Inc., Fairlawn, N.J.) which is believed to be and 80% by weight solution (20% ethanol) of the quaternary, HYAMINE® 1622 believed to be an aqueous solution of benzethonium chloride, and HYAMINE® 3500, which is believed to be a 50% aqueous solution of the quaternary (both presently commercially available from Lonza Inc., Fairlawn, N.J.).

Mixtures of cationic surfactants may also be use used in forming constituent D according to the present invention.

The cationic surfactant is preferably present in a minimum amount which is effective in providing the desired germicidal and sanitizing effects, as the blooming effect of the concentrate compositions when added to a larger volume of water have been found to be hindered by the inclusion of further amounts of the cationic surfactant taught herein into the concentrate compositions. Generally, the cationic surfactant according to constituent D is present in the concentrate compositions in amounts of up to 5% by weight and less, preferably in amounts of about 0.5–2% by weight, but most preferably in an amount of 0.8–1.2% by weight. It has been found by the inventors that the preferred amounts are in part dictated by toxicological considerations as an excess of the cationic component may pose an increasing risk of irritation to the eyes, skin and mucocous tissues of a consumer.

Constituent E) A further constituent of the concentrate compositions according to the invention are fragrances and/or fragrance enhancers which provide a characteristic pine oil scent and scent longevity, particularly wherein the concentrate compositions are diluted to form cleaning compositions therefrom. As is described in the specification under claims, the term "fragrance" is used to refer to and to include any non-water soluble fragrance substance or mixture of such substances including those which are naturally derived (i.e., obtained by extraction of flower, herb, blossom or plant), those which are artificially derived or produced (i.e., mixture of natural oils and/or oil constituents), and those which are synthetically produced substances (odiferous substances). Generally fragrances are complex mixtures or blends various organic compounds including, but not limited to, certain alcohols, aldehydes, ethers, aromatic compounds and varying amounts of essential oils such as from about 0 to about 85% by weight, usually from about 10 to about 70% by weight, the essential oils themselves being volatile odiferous compounds and also functioning to aid in the dissolution of the other components of the perfume. In the present invention, the precise composition of the perfume is of no particular consequence to cleaning performance so long as it may be effectively included as a constituent of the compositions. Generally however, one or more fragrances characteristic of pine oil type compositions, such as natural or synthetically produced fragrance compositions, especially those which are intended to mimic the scent of one or more resins or oils derived from coniferous species of trees, viz., a scent characteristic of pine oil type cleaning concentrates are used. Such fragrances may be added in any conventional manner, admixing to a concentrate composition or blending with other constituents used to form a concentrate composition, in amounts which are found to be useful to enhance or impart the desired scent characteristic to the concentrate composition, and/or to cleaning compositions formed therefrom. Fragrance effects atypical of pine oil type cleaning concentrates may be used as well.

Fragrance adjuvants for enhancing the scent effect of a fragrance, and/or for improving the miscibility of such fragrance compositions include known art fragrance adjuvants, for example, fenchol. When present, they are considered part of the fragrance constituent.

In any type of composition, the pine oil scent is the characteristic scent which is emitted by pine oil, and the longevity of such a pine oil scent is understood to be closely related to the pine oil content of a concentrate composition or a cleaning composition as described in this specification. Thus, it is normally expected that an increase in the pine oil provides an increase in the characteristic pine oil scent and in the scent longevity, however, for reasons noted earlier in this specification, the inclusion of increased amounts of pine oil is not always desirable from other standpoints. To provide a desired characteristic pine oil scent and pine oil scent longevity without requiring an increased amount of pine oil, the present inventors have found that by careful selection of fragrances and/or fragrance enhancers that a reduction in the amount of pine oil may be achieved with the retention of good characteristic pine oil scent and scent longevity, characteristics of increasing importance from a consumer acceptance and commercial considerations. However, the inclusion of such fragrances is also not without consequence as they too are known to be organic solvents and similar to pine oil, are expected to undesirably effect the blooming behaviour of pine oil cleaning compositions, particularly of the type which are described in the present specifications. Such an undesired consequence is expected to be compounded as it would be expected that to provide a desirable pine oil scent, particularly one which has a noticeable duration of up to several hours after having been applied to a surface as a cleaning composition, such fragrances and/or fragrance enhancers would typically be included in amounts higher than that normally found in similar pine oil type cleaning concentrate compositions. This is particularly true wherein the fragrance and/or fragrance enhancing constituent forms as little as 0.000001%, to as much as up to about 1.5% of the total weight of a concentrate composition as taught herein. A further undesired characteristic is an expectation of increased irritancy especially to the eyes, skin and mucocous tissues resulting from an increase in an organic solvent, particularly one which is known to emit a volatile fraction, such as an emitted scent.

The present inventors have surprisingly overcome these technical prejudices by providing pine oil type concentrates and cleaning compositions as taught herein by the judicious selection of the various constituents as taught herein which notwithstanding the amounts of organic constituents they contain maintain good scent characteristics, good cleaning with a simultaneous sanitizing and germicidal effect and good blooming behaviour, particularly when diluted in a larger volume of water to form a cleaning composition therefrom. Further, these compositions have been found to have low levels of toxicity notwithstanding the amount of the individual volatile organic constituents which they contain, and the tendency of these individual volatile organic constituents to act as irritants to the eyes, skin and mucocous tissues.

Constituent F) Water is added in order to provide 100% by weight of the concentrate composition. The water may be tap water, but is preferably distilled and/or deionized water. If the water is tap water, it is preferably appropriately filtered in order to remove any undesirable impurities such as organics or inorganics, especially minerals salts which are present in hard water which may thus interfere with the operation of the other constituents of the invention, as well as any other optional components of the liquid concentrates according to the invention.

Water is added in amounts which are sufficient to form the concentrated compositions which amount is sufficient to ensure the retention of a substantially clear characteristic when produced as a concentrate, but at the same time ensuring good blooming upon the addition of the concentrated composition to a further amount of water, or upon the addition of further water to the concentrate. This amount may be readily determined by by first mixing measured amount of Constituents A, B, C, D and E in a suitably sized vessel and then during stirring adding water. Generally, water is present in the concentrate compositions in amounts in excess of about 80% by weight, preferably in amounts of in excess of 75% by weight, but most preferably in amount of between 60–70 % by weight based on the total weight of Constituents A–F in the concentrate compositions according to the invention.

Optional constituents:

Further optional, but advantageously included constituents are one or more coloring agents which find use in modifying the appearance of the concentrate compositions and enhance their appearance from the perspective of a consumer or other end user. Known coloring agents, may be incorporated in the compositions in effective amount to improve or impart to concentrate compositions an appearance characteristic of a pine oil type concentrate composition, such as a color ranging from colorless to a deep amber, deep amber yellow or deep amber reddish color. Such a coloring agent or coloring agents may be added in any useful amount in a conventional fashion, i.e., admixing to a concentrate composition or blending with other constituents used to form a concentrate composition. However, other colors atypical of pine oil type cleaning concentrates may be used as well. Known art light stabilizer constituents useful in pine oil type compositions may also be added, particularly wherein coloring agents are used in a composition. As is known to the art, such light stabilizers act to retain the appearance characteristics of the concentrate compositions over longer intervals of time.

Other conventional additives known to the art but not expressly enumerated here may also be included in the compositions according to the invention. By way of non-limiting example these may include pH adjusters, pH buffering agents, foaming agents, further surfactants including anionic, cationic, non-ionic, amphoteric and zwitterionic surfactants, especially those useful in providing further detersive effects, and water softening agents. Such further surfactants denoted here are conventionally known; exemplary compositions are described in *McCutcheon's Detergents and Emulsifiers,* North American Edition, 1982; *Kirk-Othmer, Encyclopedia of Chemical Technology,* 3rd Ed., Vol. 22, pp. 346–387, the contents of which are herein incorporated by reference. Mixtures of two or more such surface active agents may be incorporated into the inventive compositions. Such optional, i.e., non-essential constituents should be selected so to have little or no detrimental effect upon the desirable characteristics of the present invention, namely the blooming behaviour, cleaning efficacy, disinfectant activity, and low toxicity as provided by the inventive compositions. Generally the total weight of such further conventional additives may comprise up to 10% by weight of a concentrated composition formulation.

What is to be understood by the term "concentrate" and "concentrate composition" in this specification and claims is the pre-consumer dilution and composition of the cleaning composition which is the essentially the form of the product prepared for sale to the consumer or other end user. Such a consumer or other end user would then normally be expected to dilute the same with water to form a cleaning composition. It is to be understood however that nothing in this invention would bar its use as cleaning composition without any further dilution and it may be used in the concentrations in which it was prepared for sale. Similarly, what is to be understood by the term "cleaning compositions" are the water diluted compositions which are expected to be prepared by the consumer or other end user by mixing a measured amount of the "concentrate" with water in order to form an appropriately diluted cleaning composition which is suitable for use in cleaning applications, especially in the cleaning of hard surfaces.

It is also to be understood, that proportions of one or more constituents have been and generally are referred to as percent by weight or as parts by weight based on a measure of 100% by weight, unless otherwise indicated.

As generally denoted above, the formulations according to the invention include both cleaning compositions and concentrates as outlined above which differ only in the relative proportion of water to that of the other constituents forming such formulations. While the concentrated form of the cleaning compositions find use in their original form, they are more frequently used in the formation of a cleaning composition therefrom. Such may be easily prepared by diluting measured amounts of the concentrate compositions in water by the consumer or other end user in certain weight ratios of concentrate:water, and optionally, agitating the same to ensure even distribution of the concentrate in the water. As noted, the concentrate may be used without dilution, i.e., in concentrate:water concentrations of 1:0, to extremely dilute dilutions such as 1:10,000. Desirably, the concentrate is diluted in the range of 1:0.1–1:1000, preferably in the range of 1:1–1:500 but most preferably in the range of 1:10–1:100. The actual dilution selected is in part determinable by the degree and amount of dirt and grime to be removed from a surface(s), the amount of mechanical force imparted to remove the same, as well as the observed efficacy of a particular dilution. Generally better results and faster removal is to be expected at lower relative dilutions of the concentrate in water.

EXAMPLE FORMULATIONS

Preparation of Example Formulations:

Exemplary formulations as illustrated on Table 1 following according to the instant invention were prepared in accordance with the following general procedure.

Into a suitably sized vessel, the following constituents were added in the following sequence: pine oil, co-solvent, nonionic surfactant system, fragrance/fragrance enhancer, cationic surfactants, water and lastly, optional constituents. It is to be noted however that the order of mixing is not critical in order to achieve concentrate compositions exhibiting the desired results. All of the constituents were supplied at as weight percentages, as room temperature, and mixing of the constituents was achieved by the use of a magnetic stirrer. Mixing, which generally lasted from 1 minute to 15 minutes, was maintained until the particular exemplary formulation attained uniform color and uniform clarity. Each of the formulations exhibited the following physical characteristics: transparent appearance, light orange to medium orange-brown color, and a noticeable pine oil odor. The exemplary formulations were readily pourable, and retained well mixed characteristics (i.e., stable mixtures) upon standing at room temperature (about 68° F.) for periods in excess of several weeks. The stability of the concentrate formulations was also evaluated at by heating to 120° F. determine if clouding or phase separation occurred; none was observed.

TABLE 1

| Constituent: | E1 | E2 | E3 | E4 | E5 | E6 | E7 | E8 |
|---|---|---|---|---|---|---|---|---|
| | Formulations | | | | | | | |
| Pine Oil 1 | 8 | — | — | — | — | 8 | 8 | 8 |
| Pine Oil 2 | — | 8 | 5 | 5 | 6 | — | — | — |
| Isopropanol | 9.25 | 9 | 5 | 5 | 4 | 9.25 | 9.25 | 9.25 |
| diethylene glycol n-butyl ether | — | — | 6 | 6 | 5 | — | — | — |
| Poly-Tergent ® SL-62 | 8 | 8 | 8 | 8 | 8.75 | 8 | 8 | 8 |
| Neodol ® 91-2.5 | 5 | 5 | 4 | 4 | 1.75 | 5 | 5 | 5 |
| Alkamide ® DIN 295/S | 1.4 | 1.2 | 1 | — | 1 | 1.18 | 1.5 | 1.8 |
| BTC-8358 | 0.9 | 0.9 | 1 | 1 | 1 | 0.9 | 0.9 | 0.9 |
| BTC-818 | 0.5 | 0.5 | 0.5 | 0.5 | 0.5 | 0.5 | 0.5 | 0.5 |
| Fragrance I | 1.2 | — | — | — | — | — | 1.2 | 1.2 |
| Fragrance II | — | 0.1 | 0.1 | 0.1 | 0.1 | — | — | — |
| Fragrance III | — | — | — | — | — | 0.6 | — | — |
| fenchol | 0.1 | 0.1 | 0.1 | 0.1 | 0.1 | 0.1 | 0.1 | 0.1 |
| coloring agent | 0.001 | 0.0008 | 0.0008 | 0.0008 | 0.0008 | 0.0008 | 0.0008 | 0.0008 |
| deionized water | 65.65 | 67.2 | 69.29 | 70.29 | 71.8 | 66.47 | 65.55 | 65.25 |

Pine Oil 1 is a pine oil preparation containing at least about 60% terpene alcohols
Pine Oil 2 is a pine oil preparation containing at least about 80% terpene alcohols
Poly-Tergent ® SL-62 is a nonionic alkoxylated linear alcohol surfactant
Neodol ® 91-25 is is a nonionic surfactant composition based on linear alcohol ethoxylates featuring a cloud point <20° C.
BTC-8358 is an alkyl benzyl dimethyl ammonium chloride (80% active) available from Stepan Chemical Co.
BTC-818 is a dialkyl dimethyl ammonium chloride (50% active) available from Stepan Chemical Co.
Alkamide ® DIN 295/S is a nonionic surfactant composition based on soyamide diethanolamide available from Rhone-Poulenc.

The determination of the amount of a solubilizing agent, here isopropyl alcohol, required in order to clarify the formulations of Table 1 provides a useful indication of the amount of required co-solvents which are required in typical concentrate formulations. The weight percent of isopropyl alcohol (100%) which was added to each of the formulations is also indicated on Table 1. It is to be noted that the values indicated on Table 1 are on a 100% total weight basis of the actual weight percentages of the constituents added.

Preparation of Cleaning Compositions:

Cleaning testing was performed utilizing one or more of the exemplary compositions within the scope of the invention as illustrated on Table I, and cleaning compositions prepared from known commercially available cleaning products, which are indicated as comparative examples.

COMPARATIVE EXAMPLE "C1"

A cleaning composition was formed by forming an aqueous dilution of one part by weight of Lysol® Pine-Action Cleaner, a commercially available cleaning concentrate with 64 parts by weight of water at approximately 20° C. and subsequently manually stirring the same to form a uniform mixture.

COMPARATIVE EXAMPLE "C2"

A cleaning composition was formed by forming an aqueous dilution of one part by weight of Spic and Span® Ultra Pine Deodorizing Cleaner, a commercially available cleaning concentrate with 128 parts by weight of water at room temperature (approx. 20° C.) and subsequently manually stirring the same to form a uniform mixture.

COMPARATIVE EXAMPLE "C3"

A cleaning composition was formed by mixing one part of a commercially available cleaning formulation, PineSol® Cleaner, a pine oil type cleaning concentrate, with 64 parts of water at room temperature, approximately 20° C., and manually stirring the same to form a cleaning composition therefrom.

Cleaning Evaluations:

Cleaning evaluations were also perfomed in accordance with the testing protocol outlined according to ASTM D4488 A2 Test Method, which evaluated the efficacy of the cleaning compositions on masonite wallboard samples painted with wall paint. The soil applied was a greasy soil sample containing vegetable oil, food shortening and animal fat. The sponge (water dampened) of a Gardner Abrasion Tester apparatus was squirted with a 15 gram sample of a tested cleaning composition, and the apparatus was cycled 10 times. The evaluation of cleaning compositions was "paired" with one side of each of the test samples treated with a composition according to the invention, and the other side of the same sample treated with a comparative example's composition, thus allowing a "side-by-side" comparision to be made. Each of these tests were duplicated on 20 wallboard tiles and the results statistically analyzed and the averaged results reported on Table 2, below. The cleaning efficacy of the tested compositions was evaluated utilizing a Minolta Chroma Meter CF-110, with Data Processor DP-100, which evaluated spectrophotomic characteristics of the sample. The results are reported on Table 2 following.

TABLE 2

| composition \| comparative composition | E1 \| C1 | E1 \| C2 | E1 \| C3 | E2 \| C3 |
|---|---|---|---|---|
| reflectance reading: composition \| comparative composition | 69.04 \| 67.19 | 63.68 \| 62.22 | 70.93 \| 69.82 | 65.63 \| 65.14 |

With respect to the results reported on Table 2 a value of "100" is indicative of a white (unsoiled) background, and a "0" value is indicative of a black background. A soil laden (uncleaned) surface generally provided a result of about 20–30.

As can be seen from the results of Table 2, the cleaning efficacy of the composition according to the invention provided favorable results with those of known art cleaning products.

Evaluation of Light Transmittance ("Blooming") of Formulations:

Each of the formulations described on Table 1 was evaluated to determine the degree of light transmittance, a measure of the opacity of each of these concentrated formulations. Also evaluated were comparative formulations designated as "C1" and "C2" as described above.

These aqueous dilutions were prepared to evaluate the degree of light transmittance, a measure of the opacity as well as of the blooming of each of the aqueous dilutions. Certain of these aqueous dilutions were also evaluated to determine the antimicrobial efficacy of the aqueous dilution. The results of the light transmittance evaluation was determined as a percentage of light transmitted through a sample of a particular aqueous dilution wherein the transmission of a like sample of water is assigned a percentage of 100%. Testing was performed by mixing a 3 g aliquot of a particular example formulation with 192 g of tap water (with approx. 100 ppm hardness) which formed a 1:64 dilution of the example formulation:water, after which the sample was mixed for 60 second and a transmittance reading was taken using a Brinkman model PC801 dipping probe colorimeter, which was set at 620 nm to determine the light transmission of each of the samples. Samples of each formulation at 20° C. and at 40° C. were evaluated, as well as the reference (pure tap water) sample used to calibrate the colorimeter to the reference 100% light transmission sample outlined above. The resulting determined values, reported in Table 3 below provide an empirical evaluation, reported in percent transmittance ("%T") of the degree of transparency of a diluted example formulation wherein 0% indicates complete opacity and 100% the transparency of a water sample as noted above. Accordingly, a lower %T of a particular aqueous dilution provided a more desirable indication of the blooming characteristic of the particular aqueous dilution.

TABLE 3

| | Light Transmittance | | | | | | | |
|---|---|---|---|---|---|---|---|---|
| Light Transmittance: | E1 | E3 | E4 | E5 | E7 | E8 | C2 | C3 |
| % T at 20° C. | 30–40 | 30–40 | >80 | >80 | 20–30 | 10–20 | >80 | >80 |
| % T at 40° C. | 10–20 | 30–40 | — | — | 10–20 | <10 | >80 | >80 |

As may be seen from the results described on Table 3, the formulations according to the invention were comparable to, but in most cases better than the known art formulations represented by the Comparative examples, C1 and C2.

2. Evaluation of Light Transmittance ("Blooming") of Formulations:

Further formulations according to the invention as well as further "comparative" formulations were produced; their constituents are noted on Table A1 below. The individual constituents were the same as used for the formulations of Table 1, but for the use of a different coloring agent (1% indicates weight actives) and a different fragrance.

TABLE A1

| Constituents | C4 | C5 | E9 | E10 |
|---|---|---|---|---|
| Pine Oil 80 | 8.00 | 8.00 | 8.00 | 8.00 |
| Isopropanol | 9.25 | 9.25 | 9.25 | 9.25 |
| Polytergent ® SL-62 | 8.00 | 8.00 | 8.00 | 8.00 |
| Neodol ® 91-2.5 | 5.00 | 5.00 | 5.00 | 5.00 |
| Alkamide ® DIN 295/S | 0.00 | 0.50 | 1.50 | 2.00 |
| Fenchol | 0.10 | 0.10 | 0.10 | 0.10 |
| Fragrance | 1.20 | 1.20 | 1.20 | 1.20 |
| BTC-8358 | 0.90 | 0.90 | 0.90 | 0.90 |
| BTC-818 | 0.50 | 0.50 | 0.50 | 0.50 |
| coloring agent (1%) | 0.11 | 0.11 | 0.11 | 0.11 |
| Deionized Water | 66.94 | 66.44 | 65.44 | 64.94 |

In a similar manner to that described above, the blooming characteristics of the further compositions according to the invention (designated as "E9" and "E10") as well as further comparative examples (designated as "C4", "C5") were evaluated as to their blooming characteristics by forming a 1:64 dilution of a respective example or comparative formulation in water, after which the sample was mixed for 60 seconds and a transmittance reading was taken using a Brinkman model PC801 dipping probe colorimeter set at 620 nm to determine the light transmission of each of the samples. Samples of each formulation at 20° C. and at 40° C. were evaluated and the percentage light transmittance is reported on Table A2 below.

TABLE A2

| | Percentage Light Transmittance (% T) | | | |
|---|---|---|---|---|
| | C4 | C5 | E9 | E10 |
| Bloom at 20° C. | 97 | 97 | 28 | 13 |
| Bloom at 40° C. | 86 | 92 | 11 | 2 |

As may be seen from Table A2, the formulations according to C4 and C5 having low amounts of diethanolamide and high levels of fragrance (1.2% wt.) exhibited high percentages of light transmitted, indicating very poor blooming characteristics. In sharp contrast, the formulations according to E9 and E10 having the same level of fragrance, but including at least about an equivalent amount of (in % wt.) of the diethanolamide as the fragrance featured surprisingly and substantially improved blooming characteristics as demonstrated by low percentages of light transmitted.

Thus, the inventors have surprisingly found that the detrimental effect of higher percentages of fragrance/fragrance enhancers on the blooming characteristics of such formulations may be counteracted by the inclusion of like amounts one or more alkanolamides, dialkanolamides or trialkanolamides, especially dialkanolamides particularly including diethanolamide. The presence of such materials in equal or greater weight proportions to the fragrance/fragrance enhancer constituent are among the most preferred embodiments of the present inventive compositions. The presence of amounts one or more alkanolamides, dialkanolamides or trialkanolamides in amounts equal to or greater than the fragrance/fragrance enhancer constituent provides excellent blooming characteristics at both room temperature (20° C.) and at elevated temperatures (40° C.) as shown in Table A2.

Evaluation of Scent Longevity:

An evaluation of the scent longevity of formulations according to the Example formulation "E1" described on Table 1 above, compared to a formulation according to Example "C1", also described above, in accordance with the following general protocol. The results are indicated on Table 4, below.

Individual cleaning composition based each of the two formulations was produced by mixing 4 grams of a respective formulation with 256 grams of water, which formed a representative 1:64 dilution, typical of the dilutions used for such pine oil type products in domestic environments. Next, each of these cleaning compositions was poured onto a floor surface in separate rooms and mopped with a sponge mop to cover approximately 40 square feet of floor surface with a cleaning composition. Circulation fans were turned on for 5 minutes and then turned off. Within ½ hour of mopping, two groups each consisting of 20 test panelists were asked to enter one of the rooms, stay in the room for 45 seconds, and then exit the room. Subsequently, each panelist was asked to evaluate the scent emanated by the floor, and remain outside of both test rooms in order to allow for their nasal passages to clear and become accustomed to the ambient. Afterwards, the members of the group were asked to enter the other of the two rooms, again stay in thr room for 45 seconds, exit the room, and evaluate the scent emanated by the floor in the room just visited.

After a time interval of 7 hours after mopping, and again after a 24 hour interval after mopping, each of the members of the groups repeated the above protocol, and again evaluated the scent emanated by the two treated flooring surfaces at these two later time periods. In such a manner, a meaningful evaluation of the relative pine scent, especially after the longer time periods of 7 and 24 hours after application could be obtained, and compared to a presently commercially available pine oil type cleaning composition.

TABLE 4

Scent Duration Characteristics

| Cleaning Composition: 1 part formulation: 64 parts water | Strength of pine scent: 1/2 hour after application | Strength of pine scent: 7 hours after application | Strength of pine scent: 24 hours after application |
|---|---|---|---|
| C1 | 44% | 16% | 33% |
| E1 | 56% | 84% | 67% |

The numbers indicated on Table 4, as well as being more graphically illustrated on accompanying FIG. 1, are the total percentages of the group who indicated preferance for one formulation's scent over that of the other. As can be seen, while the results following the first one-half hour following application are not dissimilar, the strength of the pine oil scent left by the formulations according to the invention as exemplified by E1 are significantly stronger, and exhibit a greater duration than that of the prior art formulation, C1.

Evaluation of Ocular Irritation:

The occular irritation characteristics of formulations according to the invention were evaluated using the known Draize Eye test protocol. Evaluation was performed on a formulation according to Example E7of Table 1 above in an "as is" composition, namely without any further dilution.

As known to those skilled in the art, the Draize Eye Test measures eye irritation for the grading of severity of ocular lesions, measuring three dimensions: scores obtained for the cornea, iris and conjunctiva. For the cornea, after exposure to the composition, A the cornea opacity is grated on a scale from 1–4; B the area of cornea involved is graded on a scale from 1–4 (where the score=A×B×5 may be a total maximum of 80). For evaluation of the iris, after exposure the composition, A the involvement of the iris is graded on a scale of 1–2 (where the score=A×5 may be a total maximum of 10). For a evaluation of the conjunctive, A Redness is graded on a scale of 1–3; B Chemosis is graded on a scale of 1–4; and C Discharge is measured on a scale of 1–3 [where the score=(A+B+C)×2 may be a maximum of 20]. The maximum total score is the sum of all scores obtained for the cornea, iris and conjunctive (a maximum of 110).

During the performance of the Draize test, the Draize test score on day 1 of the test was 19.33, and it was further observed that all signs of opacity cleared in all of the 6 subjects by day 7 of the test, although conjunctival irritation was observed in 1 of the 6 test subjects by day 7. The Draize score on day 7 of the test was 0.33. By day 14, all signs of any irritation, opacity or conjunctival irritation was observed to have cleared. The results of the Draize test indicated than an EPA Tox Category "0" was appropriate. That these results were achieved with a product known to have a significant content of constituents which individually considered are known irritants was particularly surprising.

While described in terms of the presently preferred embodiments and illustrated by the examples, above, it is to be understood that the present disclosure is to be interpreted as by way of illustration, and not by way of limitation, and that various modifications and alterations apparent to one skilled in the art may be made without departing from the scope and spirit of the present invention, which is limited only by the appended claims.

We claim:

1. A blooming pine oil cleaning concentrate composition comprising the following essential constituents:

A) 6–15% by weight of a pine oil preparation comprising at least 60% wt. terpene alcohol;

B) 0.001–15% by weight of a co-solvent;

C) 0.001–15% by weight of a non-ionic surfactant system which comprises two or more nonionic surfactants wherein at least one of which exhibits a cloud point of 20° C. or less in water;

D) 0.5–5% by weight of a cationic quaternary ammonium surfactant compound which exhibits germicidal activity;

E) 0.000001–1.5% by weight of a fragrance/fragrance enhancer other than the said pine oil preparation; and, F) water.

2. The pine oil type cleaning concentrate according to claim 1 wherein:

B) is selected from: $C_1$–$C_8$ alcohols, glycol ethers and glycols.

3. The pine oil type cleaning concentrate according to claim 1 wherein:

C) includes an ethoxylated alcohol surfactant composition which exhibits a cloud point of 20° C. or less in water.

4. The pine oil type cleaning concentrate according to claim 1 wherein:

C) includes a alkoxylated linear alcohol surfactant.

5. The pine oil type cleaning concentrate according to claim 1 wherein:

C) includes an alkanolamide surfactant composition.

6. The pine oil type cleaning concentrate according to claim 1 wherein:

D) is a quaternary ammonium compound according to the structure:

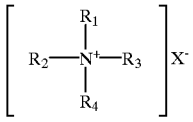

wherein;

at least one or $R_1$, $R_2$, $R_3$ and $R_4$ is selected from hydrophobic, aliphatic, aryl aliphatic or aliphatic aryl radical of from 6 to 26 carbon atoms, and any remaining $R_1$, $R_2$, $R_3$ and $R_4$ are hydrocarbons of from 1 to 12 carbon atoms, wherein any of $R_1$, $R_2$, $R_3$ and $R_4$ may be linear or branched and may include one or more ether or amide linkages; and, X is a salt-forming anionic radical.

7. The pine oil type cleaning concentrate according to claim 6 wherein:

Constituent D) is a quaternary ammonium compound according to the structure:

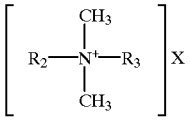

wherein $R_2$ and $R_3$ are the same or different $C_8$–$C_{12}$alkyl, or $R_2$ is $C_{12-16}$alkyl, $C_{8-18}$alkylethoxy, or $C_{8-18}$alkylphenolethoxy and $R_3$ is benzyl and X is a halide or methosulfate.

8. An aqueous cleaning composition comprising the pine oil type cleaning concentrate composition according to claim 1 dispersed in water in a weight ratio of concentrate composition:water of from 1:0.1 to 1:1000.

9. A pine oil type cleaning composition according to claim 1 which further comprises up to 10% by weight based on the total weight of the cleaning composition of one or more nonessential constituents selected from: coloring agents, light stabilizers, pH adjusters, pH buffering agents, foaming agents, further surfactants including anionic, cationic, non-ionic, amphoteric and zwitterionic surfactants, and water softening agents.

10. A process for cleaning and disinfecting a hard surface requiring such treatment which process includes the step of:

applying the composition according to claim 1 to said hard surface in an amount effective for providing cleaning and/or disinfecting treatment of said hard surface.

11. A blooming pine oil cleaning concentrate composition comprising the following constituents:

A) pine oil preparation comprising at least 60% wt. alpha-terpineol;

B) co-solvent;

C) a non-ionic surfactant system which comprises a first nonionic surfactant which exhibits a cloud point of 20° C. or less in water, a second nonionic alkanolamide surfactant, and a third nonionic alkoxylated linear aliphatic alcohol surfactant;

D) cationic quaternary ammonium surfactant compound which exhibits germicidal activity;

E) fragrance/fragrance enhancer enhancer other than the said pine oil preparation; and, F) water.

12. A blooming pine oil cleaning concentrate composition according to claim 11 comprising the following constituents:

A) 0.001–15% by weight of a pine oil preparation comprising at least 60% wt. terpene alcohol;

B) 0.001–15% by weight of co-solvent;

C) 0.001–15% by weight of a non-ionic surfactant system which comprises a first nonionic surfactant which exhibits a cloud point of 20° C. or less in water, a second nonionic alkanolamide surfactant, and a third nonionic alkoxylated linear aliphatic alcohol surfactant;

D) 0.5–5% by weight of a cationic quaternary ammonium surfactant compound which exhibits germicidal activity;

E) fragrance/fragrance enhancer other than the said pine oil preparation; and,

F) water.

13. A blooming pine oil cleaning concentrate composition according to claim 11 wherein the nonionic alkanolamide surfactant is present in an amount equal to or greater than the amount of the fragrance/fragrance enhancer.

14. A blooming pine oil cleaning concentrate composition according to claim 12 wherein the nonionic alkanolamide surfactant is present in an amount equal to or greater than the amount of the fragrance/fragrance enhancer.

15. A blooming pine oil cleaning concentrate composition according to claim 11 which comprises (A) at least 6% wt. of a pine oil preparation comprising at least 60% wt. terpene alcohol.

16. A blooming pine oil cleaning concentrate composition according to claim 12 which comprises 6–15% wt. of a pine oil preparation comprising at least 60% wt. terpene alcohol.

* * * * *